United States Patent [19]

Bernhardt et al.

[11] 4,410,034

[45] Oct. 18, 1983

[54] TEMPERING ARRANGEMENT FOR CONTAINERS

[75] Inventors: Rainer Bernhardt; Walter Kremer, both of Bergneustadt, Fed. Rep. of Germany

[73] Assignee: Jobo-Labortechnik GmbH & Co. K.G., Gummersbach, Fed. Rep. of Germany

[21] Appl. No.: 269,828

[22] Filed: Jun. 2, 1981

[30] Foreign Application Priority Data

Jun. 10, 1980 [DE] Fed. Rep. of Germany ..... 3021722

[51] Int. Cl.[3] ..... F28F 7/00

[52] U.S. Cl. ..... 165/80 E; 220/413

[58] Field of Search ..... 165/80 E, 80 R; 220/408, 410–413

[56] References Cited

U.S. PATENT DOCUMENTS

| | | | |
|---|---|---|---|
| 2,061,427 | 11/1936 | King | 165/80 E |
| 2,895,718 | 7/1959 | Prather | 165/80 E |
| 3,434,302 | 3/1969 | Stoner et al. | 165/80 E |
| 4,217,011 | 8/1980 | Davis | 220/411 X |
| 4,316,473 | 2/1982 | Beskin | 165/80 E |

*Primary Examiner*—Sheldon J. Richter

*Attorney, Agent, or Firm*—Michael J. Striker

[57] ABSTRACT

A tempering arrangement for containers, particularly for bottles with photo-developing chemicals, has a tank for accommodating a tempering bath and having an opening for inseting a container, an abutment provided in the tank and engageable with the container in an end position of the latter inside the tank, and two guiding formations provided in the interior of the tank and spaced from one another by a distance which is smaller than the transverse dimension of the container. Thereby, the container and/or the guiding formations deform during the insertion of the container into the tank.

11 Claims, 3 Drawing Figures

TEMPERING ARRANGEMENT FOR CONTAINERS

BACKGROUND OF THE INVENTION

The present invention relates to a tempering arrangement for containers, particularly for bottles with photo-developing chemicals.

Tempering arrangements of the above-mentioned general type are known in the art. A known tempering arrangement has a tank accommodating a tempering bath and having an inlet opening in a cover for insertion of the container as well as holders for providing a certain position of the container inside the tank. Such an arrangement is disclosed, for example, in the patent application No. P 2,937,068.1 This arrangement is simple, inexpensive, easy to handle and characterized by reliable holding of the container. For this purpose, an abutment is provided in the region of the inlet opening, the abutment engaging with a complementary shoulder of the associated container in the desired end position. The above-mentioned holding of the container in the tank is reliable. It is advisable, however, to additionally secure the holding of the container inside the tank without additional deformation of the arrangement and without complicated handling of the container.

SUMMARY OF THE INVENTION

Accordingly, it is an object of the present invention to provide an improved tempering arrangement for containers, particularly for bottles with photo-developing chemicals.

More particularly, it is an object of the present invention to provide a tempering arrangement in which the holding of the container inside the tank is additionally secured, and at the same time, the arrangement does not need to be additionally shaped and the container does not require complicated handling.

In keeping with these objects, and with others which will become apparent hereinafter, one feature of the present invention resides in a tempering arrangement for containers, which has a tank for accommodating a tempering bath and having an opening for inserting a container, an abutment provided in the tank and engageable with the container in an end position of the latter inside the tank, and two guiding formations provided in the interior of the tank and spaced from one another by a distance which is smaller than the transverse dimension of the container.

The guiding formations may be formed as a simple inserts or shaped portions of the wall of the tank, so that no significant increase of the costs of the arrangement is involved. The guiding formations provide for a controlled movement of the container during insertion so that the container cannot be withdrawn afterwards from the tank by itself and is secured in its end position. In accordance with the invention, the end position is attained not only because of the provision of the abutment in the tank and the shoulder in the container, as in the above-mentioned known arrangement, but also because of the mutual action between the container and the guiding formations cooperating with the latter during the insertion of the container into the tank. The inwardly extending guiding formations provide a narrowing of the receiving space for the container, as compared with the respective dimension of the container, the narrowing acting during at least a transition phase of the insertion of the container between its initial and end positions.

The narrowing for the passage of the container causes a deformation which does not cause any hindrance during the insertion of the container by hand, but reliably precludes a return movement of the container by itself. This deformation may be attained in the construction in which the guiding formations are elastically yieldable. It suffices, however, and makes easier the manufacture when the required yielding is attained by the elastically deformable container when the latter is composed of synthetic plastic material possessing inherent elastic yieldability.

During the displacement of the container to its end position a maximum of a work of deformation takes place in the region of the container and/or in the region of the guiding formations. In the end position of the container, such a deformation can continue, so that the abovementioned holding of the container by the cooperation of the abutment and the shoulder is complemented by a certain clamping action. It suffices, however, as mentioned above, to provide the deformation during the transition phase of the insertion of the container, so that the deformation of the container or the guiding formations no longer takes place in the end position. For a reverse movement of the container during withdrawing of the same from the tank, the above-mentioned work of deformation must be performed again, whereby the end position of the container is especially reliably secured.

Instead of or in addition to the above-mentioned deformation, the guiding formations may provide a turning movement of the container during the insertion. The container moves in the direction which is such that in the end position a reliable interengagement of the above-mentioned abutment of the tank and the shoulder of the container is provided. Thereby, the container performs during the insertion a kind of an inwardly engaging movement whose progress is determined by the mutual action between the container and the guiding formations of the tank. It is thereby possible to select shapes and positions between the abutment and the shoulder of the container which otherwise, because of unsufficient security of holding, could not be utilized. In accordance with the invention, there is no limitation in this sense because of the additional turning during the insertion and the location, shape and inexpensive construction of the abutment means can be selected.

The novel features of the present invention which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
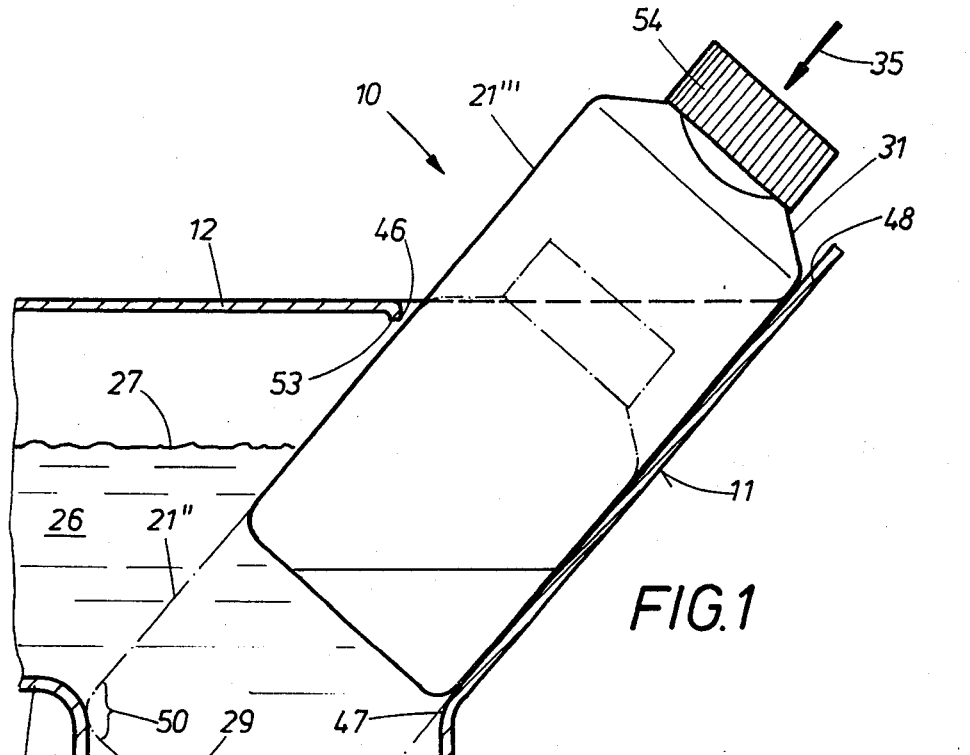
FIG. 1 is a view showing a tempering arrangement with a container in an initial phase of its insertion into a tank of the arrangement.
Figure 2:
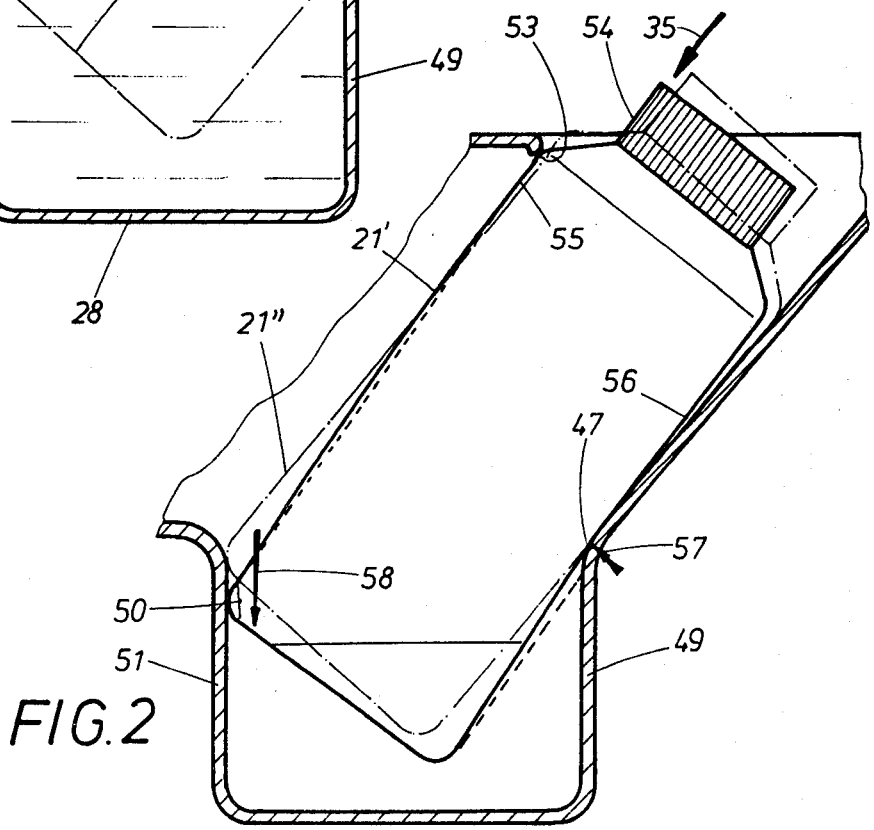
FIG. 2 is a view showing the container in an intermediate phase of its insertion into the tank.
Figure 3:
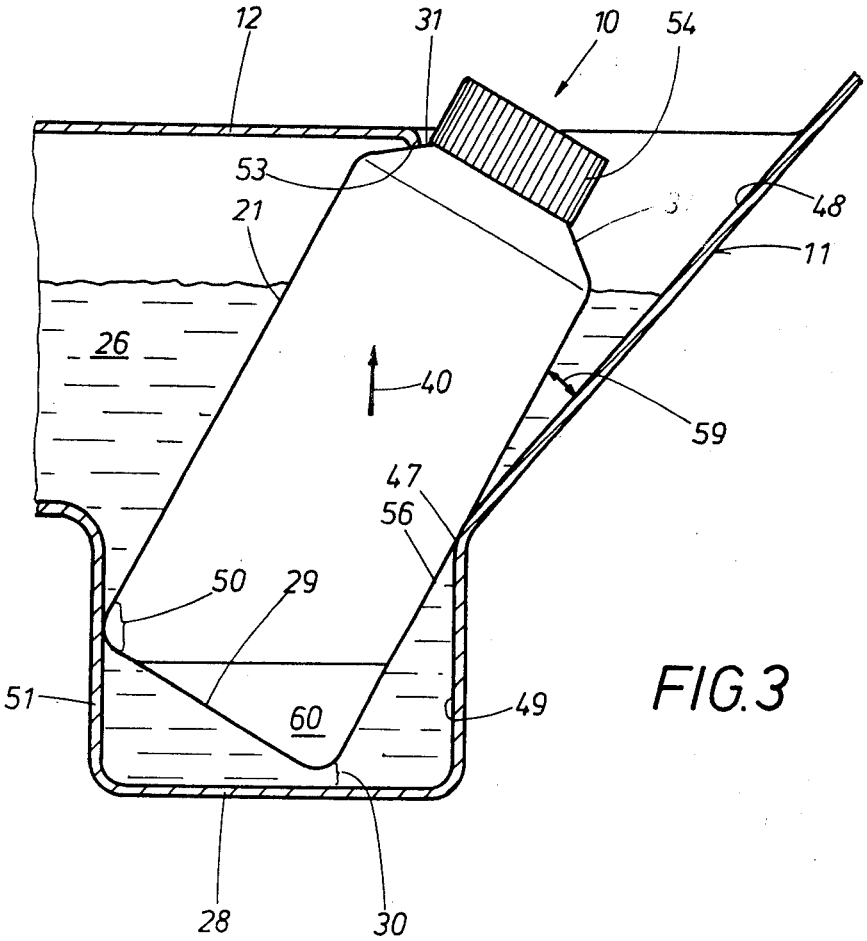
FIG. 3 is a view showing the container in its end position.

A tempering arrangement for containers is identified in toto by reference numeral 10 and includes a tank 11 only a fragment of which is shown in the drawing, and a cover 12. An inlet opening 46 is provided in the cover 12 for insertion of a container 21. During its insertion and withdrawal the container 21 displaces between several movement phases which are shown in FIGS. 1–3 and identified respectively by reference numerals 21', 21'' and 21'''. A bath liquid 26 is accommodated in the tank 11 and has a level 27.

The tank 11 has a side wall provided with a bend 47 and an inclined ramp 48 in its upper part for guiding the container. The initial position of the container is identified by reference numeral 21''', and the container slides along the ramp 48 in the direction identified by reference numeral 35 for insertion into the tank. The opening 46 of the cover 12 has such a dimension that the container can be inserted through the same with play. At the end of this phase of the insertion movement 35, the container comes to an abutment position which is identified at 21'' and shown in dash-dot lines in FIGS. 1 and 2. In this position a bottom 29 of the container in its corner region 50 reaches an abutment face 51 which in the simples case is formed by a respective shape, here a step of a wall 52 of the tank. In the position 21'' the container, however, is not secured in the tempering arrangement. It is not yet located in the end position shown in FIG. 3 in which an abutment 53 provided in the region of the inlet opening 46 engages with a shoulder 31 of the container 21. The shoulder 31 is formed here as a step in a neck of the container formed as a bottle, the neck being closed by a threaded cap 54 or the like. The abutment 53 is formed here as a downwardly bent edge region of the opening 46 in the cover 12.

When the container is in its abutment position 21'' shown in dash-dot lines in FIG. 2, a certain resistance can be recognized when the container is pressed in the region of its threaded cap 54 in the direction of the arrow 35. The difference between the bend 47 of the wall 48 (which merges into a bend portion 49) and the abutment face 51 at the other side of the container is formed narrower than the respective dimension of the container. Because of the above-mentioned play in the region of the opening 46, the container also turns in the region of the bend 47, whereby one container wall 55 abuts against the above-mentioned abutment 53 as shown in FIG. 2.

The container is now in a three-point contact on the abutment face 51, the bend 57, and the abutment 53. The increased force consumption in the insertion direction 35 tends to cause a deformation which acts so as to deform the container when it is constituted of an elastically deformable synthetic plastic material. The container in the deformed position is identified by reference numeral 21' in FIG. 2. A longitudinal wall 56 of the container is somewhat inwardly pressed in the region of the bend 47 as shown in dotted lines and identified by the deformation arrow 57 in FIG. 2. The opposite longitudinal wall 55 of the container is somewhat curved in convex manner as shown in dotted lines in FIG. 2, because of the abutment of the container between the abutment face 51 and the abutment 53. Because of these shape changes of the container 21', the latter can slide along the abutment face 51 with its corner region 50 as identified by the arrow 58, when the pressure continues to act in the insertion direction 35.

During further pressing in the insertion direction 35, the above-mentioned shoulder 31 in the neck of the container reaches a position under the abutment 53, as can be seen from FIG. 3. Now, the container 21 can be moved to its released position which is the above-mentioned end position of the container in the tempering arrangement 10. The container 21 performs a turning movement in the latter movement phase between the abutment face 51 and an opposite bend 47 between the portions 48 and 49 of the wall. This turning movement is determined by an angular distance 59 in between the wall 56 of the container and the upper inclined ramp 48 of the wall of the tank. The displaced shoulder 31 of the container 21 lies under the abutment 53 and takes up a buoyant force 40 of the container 21. The greater is the buoyant force 40 depending upon the filling degree 60 of the container 21, the safer the shoulder 31 abuts against the abutment 53. The bend 47 and the abutment face 51 of the tank 11 are located thereby in the lower region of a container 21 at the container wall 56 and its corner region 50. A free space 30 can remain between the bottom 28 of the tank 11 and the bottom 29 of the container 21.

When it is necessary to move the container from its end position so as to withdraw the same from the tank, the container must be displaced in an opposite direction and assume the deformed shape shown in FIG. 2 which cannot be attained by itself without the user. It is allowed that the container in its bent position has a certain residual deformation. In this case during the insertion of the container in its movement phase 58, a stronger deformation of the container takes place, which provides the same safety of the container position as in the shown example wherein the end position is attained by a full release of the container 21.

The guiding face 51 and the pressure ridge 47 are shown in the drawing as formed in the walls of the tank 11. It is, however, possible to provide inserts which are separate from the tank 11 and are arranged inside the latter. It is also possible to attain the reliable position of the container not by the deformation of the container itself, but by the deformation of the above-mentioned guiding formations 51 and 47. In the shown example, the container has a rectangular cross-section whereby the above-described mutual action between the tank and the container are based not on a point contact, but on a line contact between the respective parts. The linear contact of the container and the tank is highly advantageous.

It will be understood that each of the elements described above, or two or more together, may also find a useful application in other types of constructions differing from the types described above.

While the invention has been illustrated and described as embodied in a tempering arrangement for containers, particularly for bottles with photo-developing chemicals it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A tempering arrangement for containers, particularly for bottles with photodeveloping chemicals, comprising a tank for accommodating a tempering bath and having an opening arranged for inserting a container, said container provided with a shoulder; an abutment formation provided adjacent to said opening of said tank; and guiding means for guiding the container during its insertion into said tank in one direction and thereafter deflecting the container in another direction transverse to said one direction so that the container assumes in said tank its end position in which the shoulder of the container engages behind said abutment formation of said tank to prevent unintentional rearward movement and withdrawal of the container from said tank.

2. A tempering arrangement as defined in claim 1, wherein said tank has a main part and a cover, said opening of said tank being formed in said cover.

3. A tempering arrangement as defined in claim 1, wherein said guiding formations of said tank are elastically deformable so that they are deformed during the insertion of the container into said tank.

4. A tempering arrangement as defined in claim 1, wherein the container has two opposite sides, one of said guiding formations being formed as a pressure ridge facing toward one side of the container, and the other of said guiding formations being formed as an abutment face facing toward the other side of the container, so that said pressure ridge and said abutment face surround the container and cooperate with the same during the insertion of the container into said tank.

5. A tempering arrangement as defined in claim 1, wherein said tank has a wall with a plurality of wall portions which are shaped so as to form said guiding formations.

6. A tempering arrangement as defined in claim 1, wherein the shoulder of the container and said abutment formation of said tank are formed so that in the end position of the container the shoulder is located under said abutment formation, as considered in direction of a buoyant force urging the container outwardly of said tank.

7. A tempering arrangement for containers, particularly for bottles with photo-developing chemicals, comprising a tank for accommodating a tempering bath and having an opening for inserting a container with a predetermined transverse dimension; an abutment provided in said tank and engageable with the container in an end position of the latter inside said tank; and means for guiding the container during its insertion into said tank and including two guiding formations provided in the interior of said tank and spaced from one another by a distance which is smaller than the transverse dimension of the container, the container having two portions each of which cooperates with a respective one of said guiding formations and is elastically deformable, so that said portions are deformed during the insertion of the container into said tank, said guiding formations being also elastically deformable so that they are also deformed during insertion of the container into said tank.

8. A tempering arrangement as defined in claim 7, wherein said guiding formations are arranged so that the container upon insertion into said tank can turn in the interior of the latter for assuming said end position.

9. A tempering arrangement for containers, particularly for bottles with photodeveloping chemicals, comprising a tank for accommodating a tempering bath and having an opening for inserting a container with a predetermined transverse dimension; an abutment provided in said tank and engageable with the container in an end position of the latter inside said tank; and means for guiding the container during its insertion into said tank and including two guiding formations provided in the interior of said tank and spaced from one another by a distance which is smaller than the transverse dimension of the container, one of said guiding formations being formed as a pressure ridge facing toward one side of the container, and the other of said formations being formed as an abutment face facing toward an opposite side of the container, so that said pressure ridge and said abutment face surround the container and cooperate with the same during the insertion of the container into said tank, said tank having a wall including a first wall portion which is provided with a bend forming said pressure ridge and with an insertion ramp extending from said pressure ridge toward said opening and serving for guiding the container during its initial stage of the insertions.

10. A tempering arrangement as defined in claim 9, wherein the container has two portions with each of which a respective one of said guiding formations cooperates, said portions of the container being elastically deformable, so that they are deformed during the insertion of the container into said tank.

11. A tempering arrangement as defined in claim 9, wherein the container moves during its insertion into the tank from an initial position to said end position, said guiding formations forming a narrowing passage for the container between said initial and end position during the insertion of the container.

* * * * *